US005915764A

United States Patent [19]

MacDonald

[11] Patent Number: 5,915,764

[45] **Date of Patent: *Jun. 29, 1999**

[54] SECURITY DOOR ASSEMBLY

[76] Inventor: Edwin A. MacDonald, 1013 Granite La., DeSoto, Tex. 75115

[ * ] Notice: This patent is subject to a terminal disclaimer.

[21] Appl. No.: 08/895,953

[22] Filed: Jul. 17, 1997

Related U.S. Application Data

[63] Continuation of application No. 08/795,326, Feb. 4, 1997, Pat. No. 5,697,654, which is a continuation of application No. 08/383,831, Feb. 6, 1995, abandoned.

[51] Int. Cl.[6] ..... E05C 5/00

[52] U.S. Cl. ..... 292/66; 292/39; 292/36; 70/118

[58] Field of Search ..... 292/6, 7, 39, 63, 292/157, 36, 37, 40, 48, 51, 52, 66, 160, 158, 161, 209, 210, 340; 49/316, 319; 109/59 R, 70

[56] References Cited

U.S. PATENT DOCUMENTS

| | | | |
|---|---|---|---|
| 165,752 | 7/1875 | Naylor et al. | 70/118 |
| 447,488 | 3/1891 | Corliss | 292/40 |
| 1,929,753 | 10/1933 | Maxwell | 292/340 X |
| 2,591,111 | 4/1952 | Willett et al. | 70/355 |
| 3,007,732 | 11/1961 | Schlage | 292/341.12 |
| 3,287,055 | 11/1966 | Schlage | 292/341.12 |
| 3,390,908 | 7/1968 | Schlage | 292/340 X |
| 4,211,442 | 7/1980 | Hansen | 292/340 |
| 4,376,379 | 3/1983 | Gotanda | 70/118 |
| 4,476,700 | 10/1984 | King | 70/99 |
| 4,621,845 | 11/1986 | Vanago | 292/37 |
| 4,971,369 | 11/1990 | Jean | 292/36 |
| 5,070,650 | 12/1991 | Anderson | 292/340 |
| 5,086,587 | 2/1992 | Andrews | 49/395 |
| 5,088,786 | 2/1992 | Linder | 292/92 |
| 5,318,333 | 6/1994 | Dreifert | 292/336.3 |
| 5,333,920 | 8/1994 | de Rover | 292/48 |

FOREIGN PATENT DOCUMENTS

| | | | |
|---|---|---|---|
| 826241 | 3/1938 | France . | |
| 1099292 | 9/1955 | France | 49/316 |
| 1 548 593 | 12/1968 | France . | |
| 2 598 456 | 11/1987 | France . | |
| 2 652 378 | 3/1991 | France . | |
| 339 532 | 8/1959 | Switzerland . | |
| 14476 | 9/1889 | United Kingdom | 49/319 |

OTHER PUBLICATIONS

Bastion Security (Developments) Ltd., brochure entitled "Bastion High Security Door Systems", date of publication unknown.

*Primary Examiner*—Darnell M. Boucher
*Attorney, Agent, or Firm*—Robert A. Samra

[57] ABSTRACT

A security door assembly or locking mechanism for securing a single door in locking engagement with an adjacent door jamb structure comprises a first elongate metal blade to be received by a matching elongate groove in a vertical edge of a door. A second elongate metal blade is received by a matching groove in an upper horizontal edge of the door. Mechanical devices are provided for moving said blades partially from the grooves in the door into engagement with receiving grooves in the adjacent door jamb structure to lock the door. The vertical and horizontal blades are coupled together by a linkage mechanism which enables both blades to be operated simultaneously upon actuation of a single lever or knob. The blades and the linkage mechanism are mounted in an L-shaped housing inserted into grooves formed in adjacent edges of the door. Elongate metal strips are provided to be mounted over the grooves in the door jamb. The metal strips are provided with slots through which the blades pass to lock the door to the door jamb.

25 Claims, 8 Drawing Sheets

SECURITY DOOR ASSEMBLY

This application is a continuation of application Ser. No. 08/795,326 filed Feb. 4, 1997, now U.S. Pat. No. 5,697,654 which is a continuation of application Ser. No. 08/383,831 filed Feb. 6, 1995, now abandoned.

BACKGROUND OF THE INVENTION

1. Field of the Invention

This invention relates generally to apparatus for ensuring the closure of a door and more particularly to apparatus for locking a door against forcible entry.

2. Description of the Prior Art

It is desirable to lock a door, which typically provides entrance to a household, against entry by an intruder. To this end, locking mechanisms such as deadbolts have been utilized to discourage unlawful entry. Commercial dead bolts typically include a metal bar and upon activation insert the metal bar into a receiving aperture in a door jamb. The metal bars range in length from ¾ an inch to 1 and ½ inches. While dead bolts do prevent access through the use of plastic cards which are so effective in gaining illegal entry through the common door lock whose locking bar includes a tapered face which can be pushed to an open position by the use of the plastic card, the dead bolt offers little or no protection against "kick-in's". Because the dead bolt has a single point of contact, the application of force such as a stout kick will tear the dead bolt from the door jamb and permit access to a house, a business, and any other establishment where security against unlawful entry is desired. There are, of course, multi-point locking systems. These however are cost prohibitive.

It is therefore an object of the present invention to provide a security locking mechanism for a door which is operable from either side of the door and prevents entry by "kick-in", "prying" or "jimmying".

It is another object of the present invention to provide a security locking mechanism that can be installed in existing doors.

It is still another object of the present invention to provide a security door assembly having a self-contained locking assembly therein adapted for securing the top and adjacent side of a door in locking engagement with adjacent door jamb structure.

It is yet another object of the present invention to secure the locking assembly in either a locked position or an open position.

SUMMARY OF THE INVENTION

A security door assembly or locking mechanism for securing a single door in locking engagement with an adjacent door jamb structure comprises a first elongate metal blade to be received by a matching elongate groove in a vertical edge of a door. A second elongate metal blade is received by a matching groove in an upper horizontal edge of the door. Means are provided for moving said blades partially from the grooves in the door into engagement with receiving grooves in the adjacent door jamb structure to lock the door. The vertical and horizontal blades are coupled together by a linkage mechanism which enables both blades to be operated simultaneously upon actuation of a single lever or knob. The blades and the linkage mechanism are mounted in an L-shaped housing inserted into grooves formed in adjacent edges of the door. Elongate metal strips are provided to be mounted over the receiving grooves in the door jamb. The metal strips are provided with slots through which the blades pass to lock the door to the door jamb.

In one embodiment the single lever or knob drives an operating mechanism which provides the means for moving the blades into and out of engagement with the door jamb. The operating mechanism comprises an actuating bar terminating in an arcuate toothed segment and coupled to one of the blades. A second arcuate toothed segment mates with the first mentioned toothed segment and is rotated by the single lever to in turn rotate the first mentioned toothed segment to cause the blades to move into and out of engagement with the door jamb.

A preferred embodiment of an operating mechanism locks the blades in a retracted position and also in an extended position to prevent inadvertent movement to the blades that might be caused by vibration and the like.

DETAILED DESCRIPTION

Figure 1:
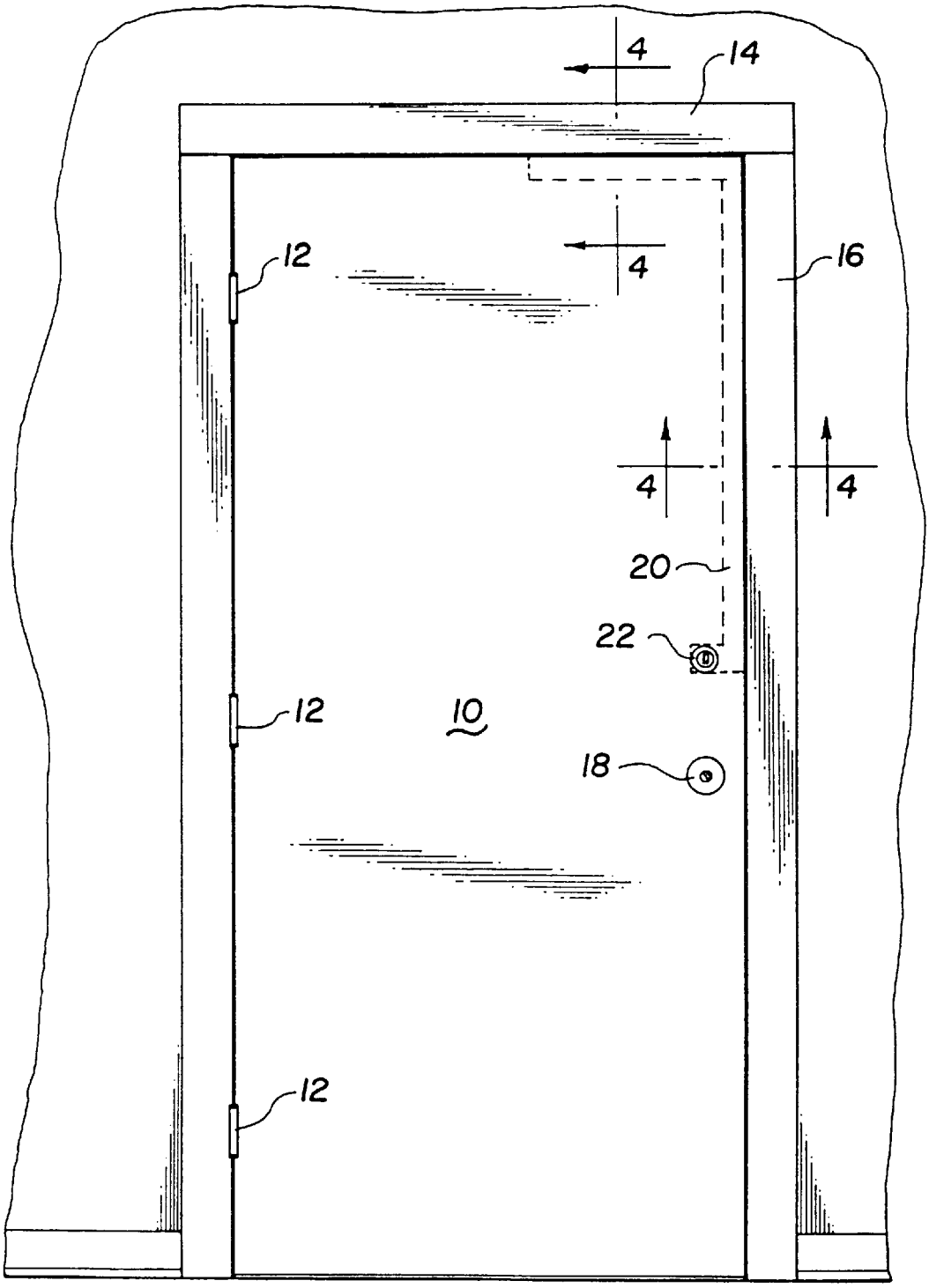
FIG. 1 is an elevational plan view of an entry door having installed therein the security locking mechanism of the present invention.
Figure 2:
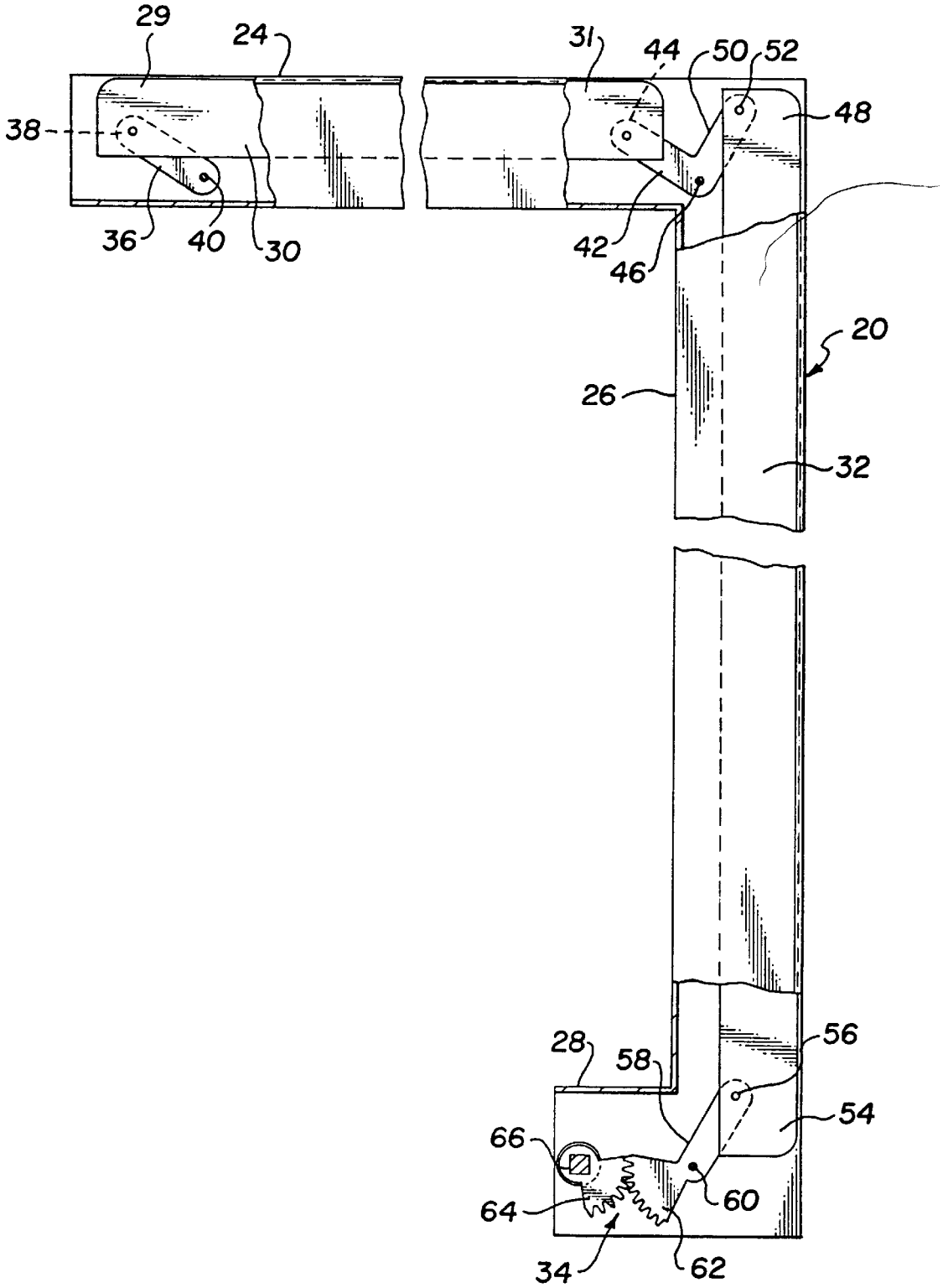
FIG. 2 is a front plan view of the security locking mechanism of the present invention ready for installation in an entry door.
Figure 3:
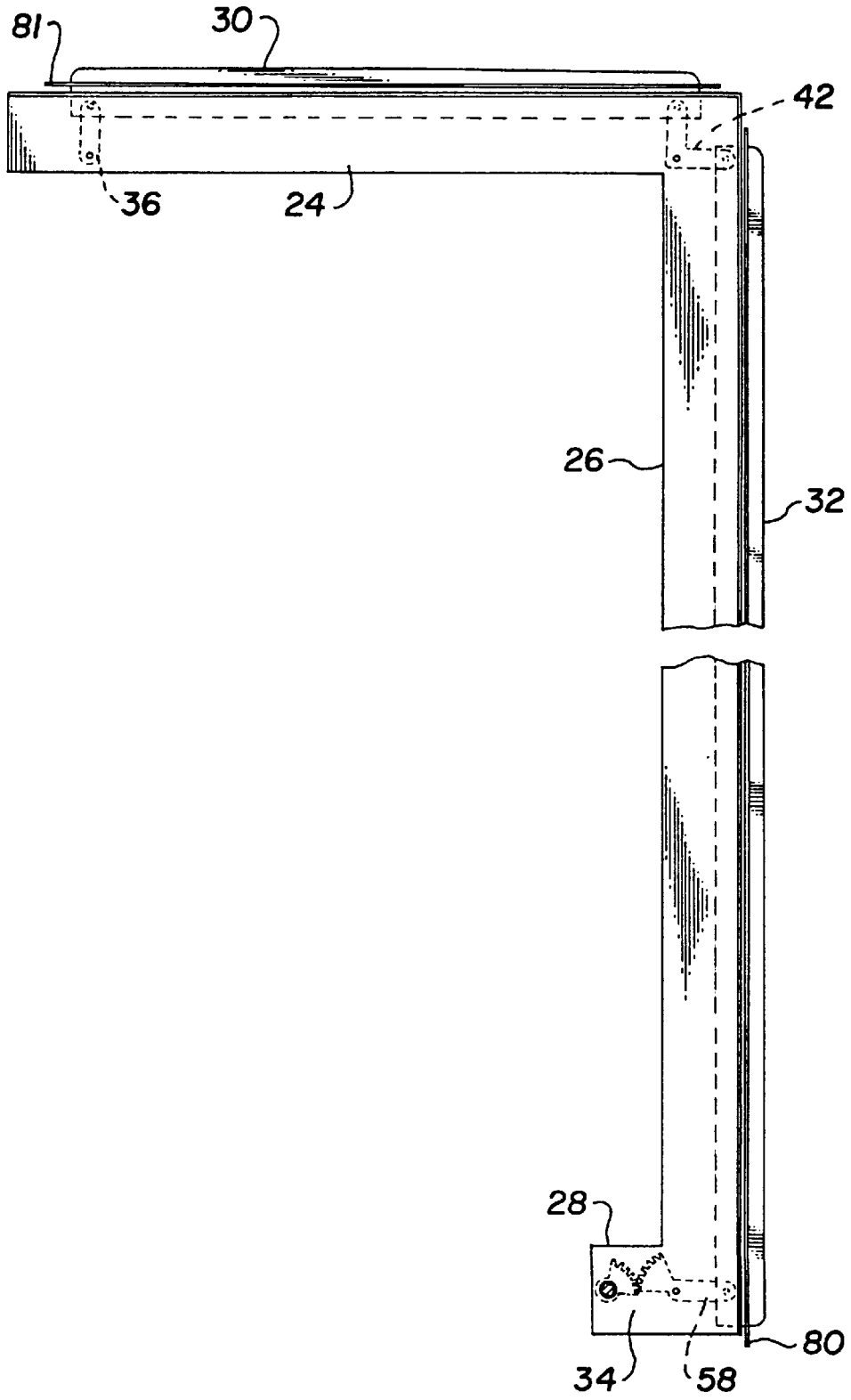
FIG. 3 is a front planned view of the security locking mechanism of the present invention with locking blades extended for engagement with the adjacent door jambs.

Referring now to FIGS. 1, 2, and 3; a door 10, typically a wooden door either solid or hollow core, is shown mounted by way of hinges 12 within door jamb segments 14 and 16. The door 10 includes a knob 18 for opening and closing the door when security locking mechanism 20 is in a fully retracted position as shown, and thus the door is in a unlocked condition. Lever or knob 22 is used to move the security locking mechanism 20 from between locked and un-locked positions. A matching lever or knob (not shown) is provided with a keyed assembly to permit a householder to secure the locking mechanism 20 from operation when the householder leaves the premises and to unlock the mechanism to permit its operation to gain access by opening the door.

The security locking mechanism 20 is comprised of U-shaped metal channel segments 24, 26, and 28 joined together as by welding to provide a unitary structure to be received by grooves formed in edges of the door 10. Channel segment 24 receives a locking blade 30; the channel segment 26 receives a locking blade 32, and channel segment 28 receives an operating mechanism 34. An inner end 29 of the blade 30 is pivotally mounted to bar 36 at 38 with the opposite end of the bar 36 pivotally mounted to a side wall of channel segment 24 at 40. The opposite end 31 of blade 30 is pivotally mounted to an L-shaped bar 42 at 44, and L-shaped bar 42 is pivotally mounted to a side wall of the channel segment 24 at 46. An upper end 48 of blade 32 is pivotally mounted to arm 50 of the L-shaped bar 42 at 52. A lower end 54 of the blade 32 is pivotally mounted at 56 to an end of actuating bar 58. An opposite end of the actuating bar 58 is rotatably mounted at 60 to a side wall of the channel segment 28. Rotation of the operating bar 58 about the pivot point 60 will move the blade 32 downward and outward from the channel segment 26. This movement in turn will cause the L-shaped bar 50 to rotate about pivot point 60 and cause the blade 30 to move upward and outward from the channel segment 24. The resulting movement of the blades into a locking position is shown in FIG. 3.

In the locking position the blades 30 and 32 enter through plates 80 and 81 into receiving grooves in the door jambs 14 and 16 respectively. Because of the lengths of blades 30 and 32 in contact with the jambs, there is provided a "kick-in" proof structure for the door 10.

Means for rotating the operating bar 58 may be provided by any number of structures. Preferably, mechanism 34 is utilized to rotate the operating bar 58. The mechanism 34 is comprised of a toothed arcuate segment 62 engaging a mating toothed segment 64 attached to shaft 66. Counter-clockwise rotation of the shaft 66 will rotate the toothed segment 64 and in turn, the tooth segment 62 to rotate the operating bar 58 in a clockwise direction to move the blades 30 and 32 out from the their respective channel segments 24 and 26 to engage mechanically with jam structure of the door 10.

Figure 4:
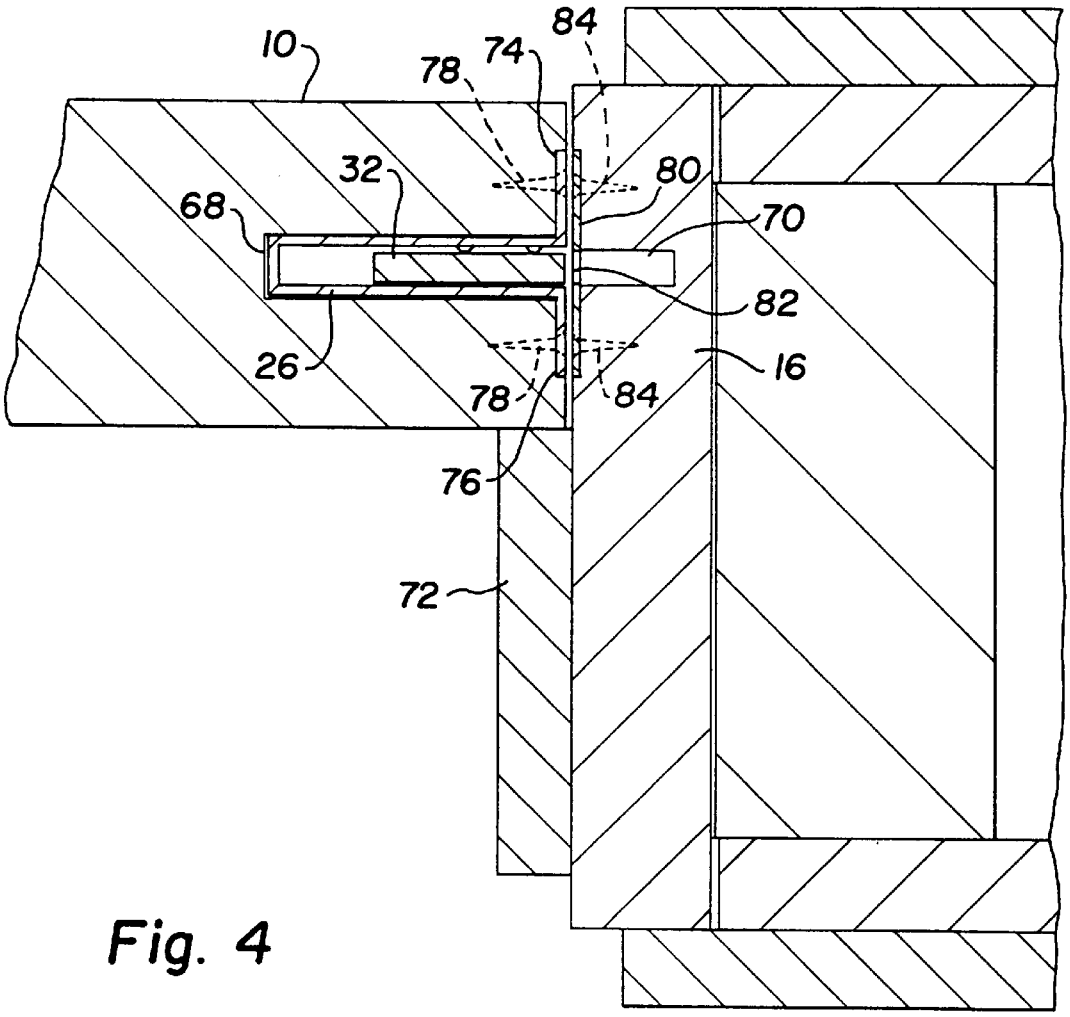
FIG. 4 is across section of a portion of the entry door of FIG. 1 taken along lines 4, 4 illustrating a locking blade in a withdrawn position.

Referring now to FIG. 4 channel segment 26 is shown received in groove 68 formed in the edge of the door 10. Blade 32 is received within channel segment 26 for movement into and out of the channel segment 26. As the locking blade 32 is moved out of the channel segment 26 it is received by slot or groove 70 formed in jamb structure 16. Jamb structure 16 includes a stop 72 for limiting the inward movement of the door. Channel segment 26 is provided with flanges 74 and 76 for securing the channel segment 26 within the slot or groove 68 by way of wood screws 78. A metal strip 80 provided with slot 82 is provided to enforce jamb structure 16. A similar metal strip 81 is provided to reinforce upper jamb structure 14. In a lock position the blade 32 passes through the slot 82 of the strip 80 into the receiving groove or slot 70 formed in the jamb structure 16. The metal strip 80 is secured to the jamb structure 16 by way of wood screws 84. The metal strip 81 is similarly secured to jamb structure 14.

Figure 5:
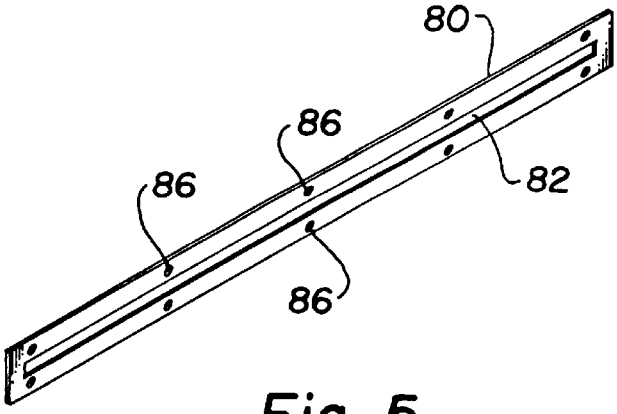
FIG. 5 is a perspective of a reinforcing bar to be secured to the door jamb and being slotted to receive a locking blade.

Details of the reinforcing strip 80 are shown in FIG. 5 include the slot 82 and a plurality of apertures 86 through which the wood screws 84 pass. The reinforcing strip 81 is of the same design but of shorter length.

In order to accommodate the linkage bars 36, 42 and 58, the inner width of the channel segments 24, 26, and 28 is made larger than the thickness of the locking blades 30 and 32. In order to reduce lateral movement of the locking blades within the segments 24, 26, and 28, the inner surface of each of the channels is provided with protrusions 88 which engage or contact a side of each of the blades to reduce lateral movement and make for smooth operation.

Figure 6:
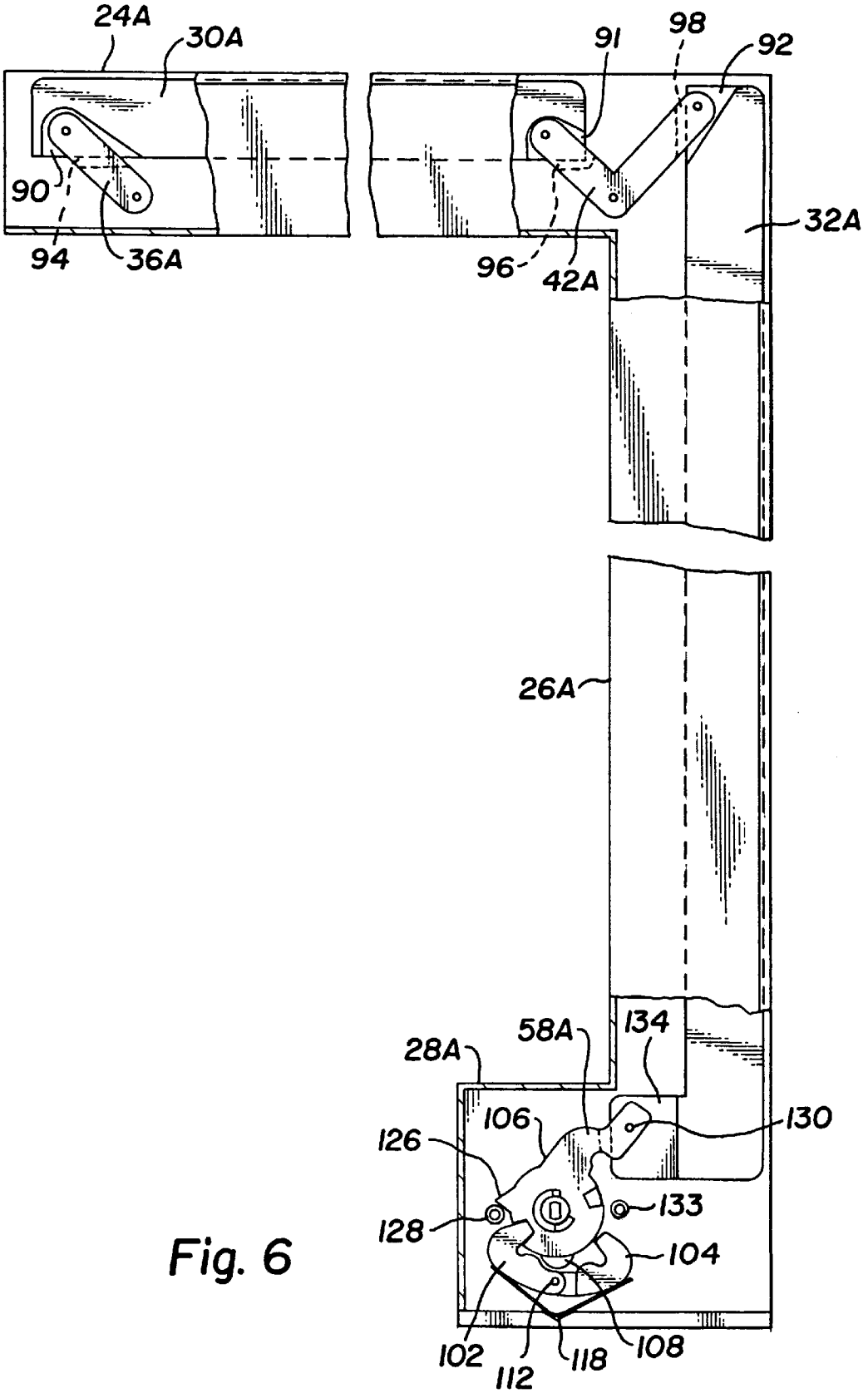
FIG. 6 is a plan view of a preferred operating mechanism with the blades shown restrained in an unlock or retracted position.
Figure 7:
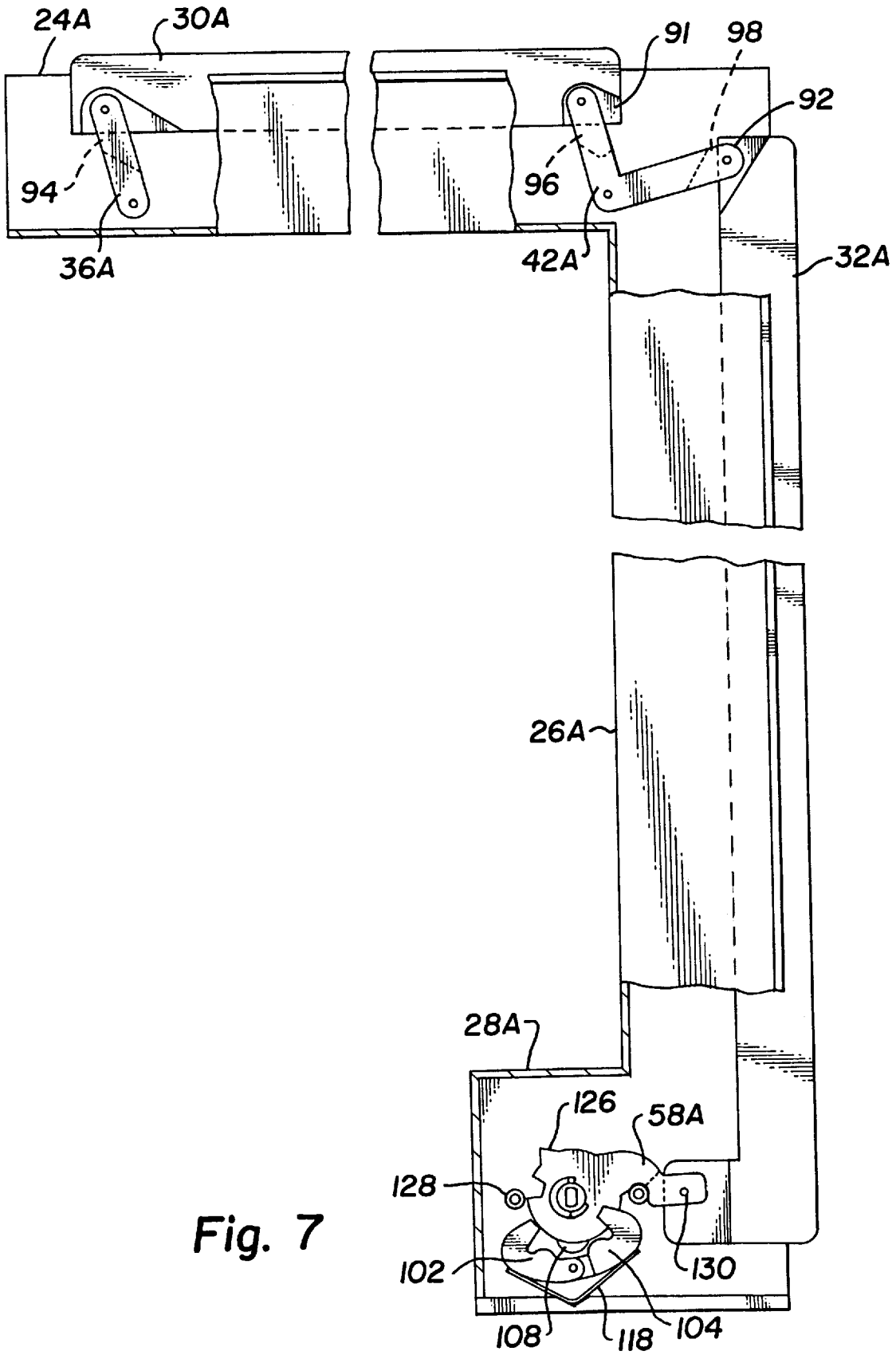
FIG. 7 is a plan view of the preferred operating mechanism with the blades shown restrained in a lock or extended position.

A modification of the present invention is illustrated in FIGS. 6–9. Like the embodiment of FIGS. 1–5 the modification (FIGS. 6 and 7) include locking blades 30A and 32A and respectively located in sheet metal channel segments 24A and 36A. In FIG. 6, the blades 30A and 32A are shown in a fully retracted position whereby the door may be opened. In FIG. 7 the blades 30A and 32A are shown in a fully extended position to lock a door against entry. Upper blade 30A is relieved or otherwise reduced in thickness in areas 90 and 91. Similarly, the side blade 32A is relieved or reduce in thickness in area 92. While 36A is relieved or reduce in thickness on the surface, contacting area 90 and the L-shaped bar 42A is reduced in thickness or otherwise relieved at 96 and 98 the surfaces or which engage the relieved surfaces 91 and 92 respectively of the blades 30A and 32A. The reduction in thickness is approximately one-half the thickness of the elements such that all surfaces of the blades 30A and 32A and the rods 36A and 42A all lie in the same plane. This avoids a need for the protrusions 88 shown in FIG. 4 permitting smooth movement of the blades 30A and 32A within the U-shaped metal channel segments 24A and 26A.

Figure 9:
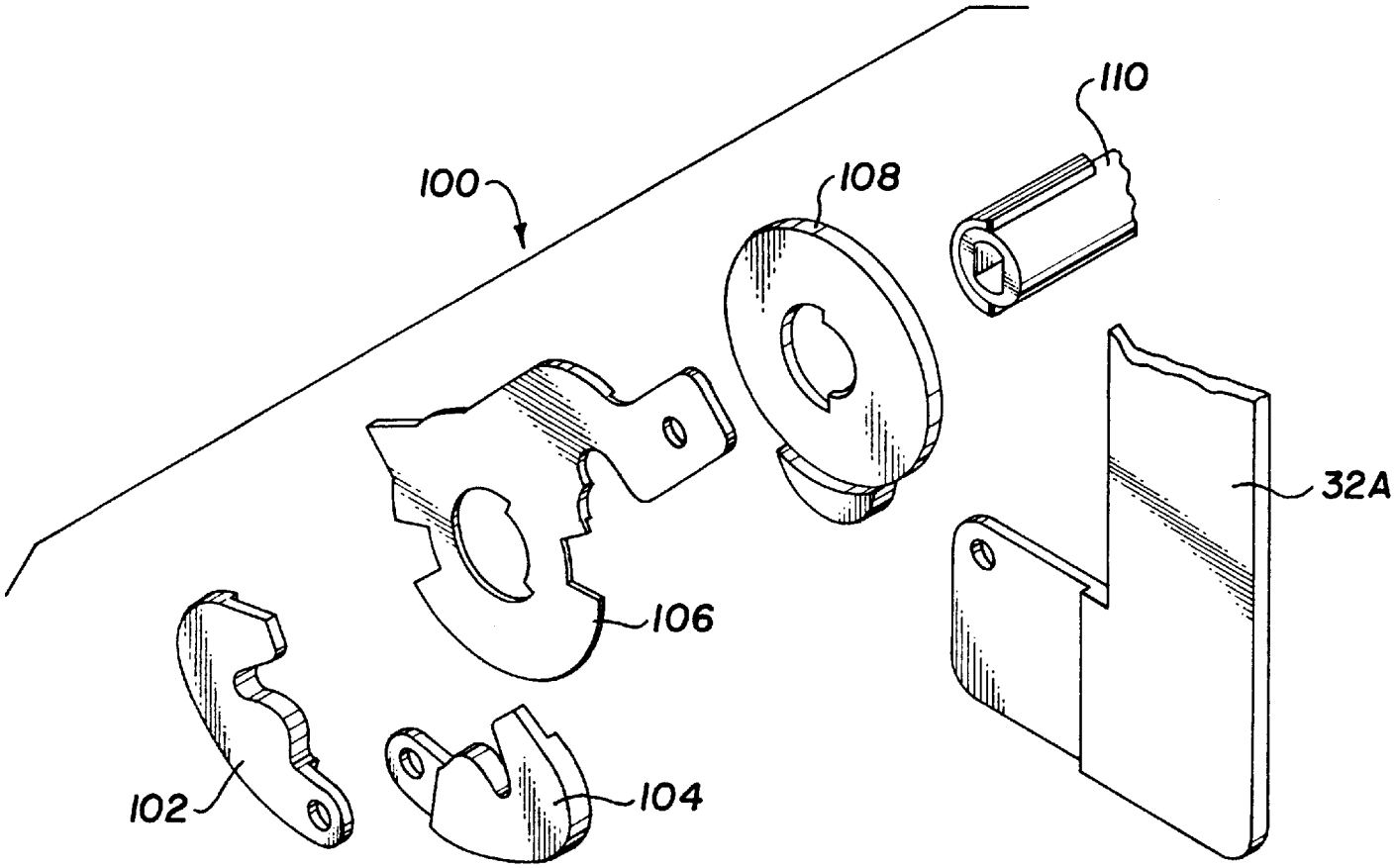
FIG. 9 is an exploded view of the operating mechanism.

An operating mechanism 100 for moving the locking blades into and out of the U-shaped metal channel segments is illustrated in exploded view in FIG. 9. The operating mechanism comprises a left hand hook or pawl 102, a right hand hook or pawl 104, and operating arm 106 and a cam 108. The operating mechanism 100 is under control of a shaft 110 extending from a door knob or door handle (not shown).

Figure 8:
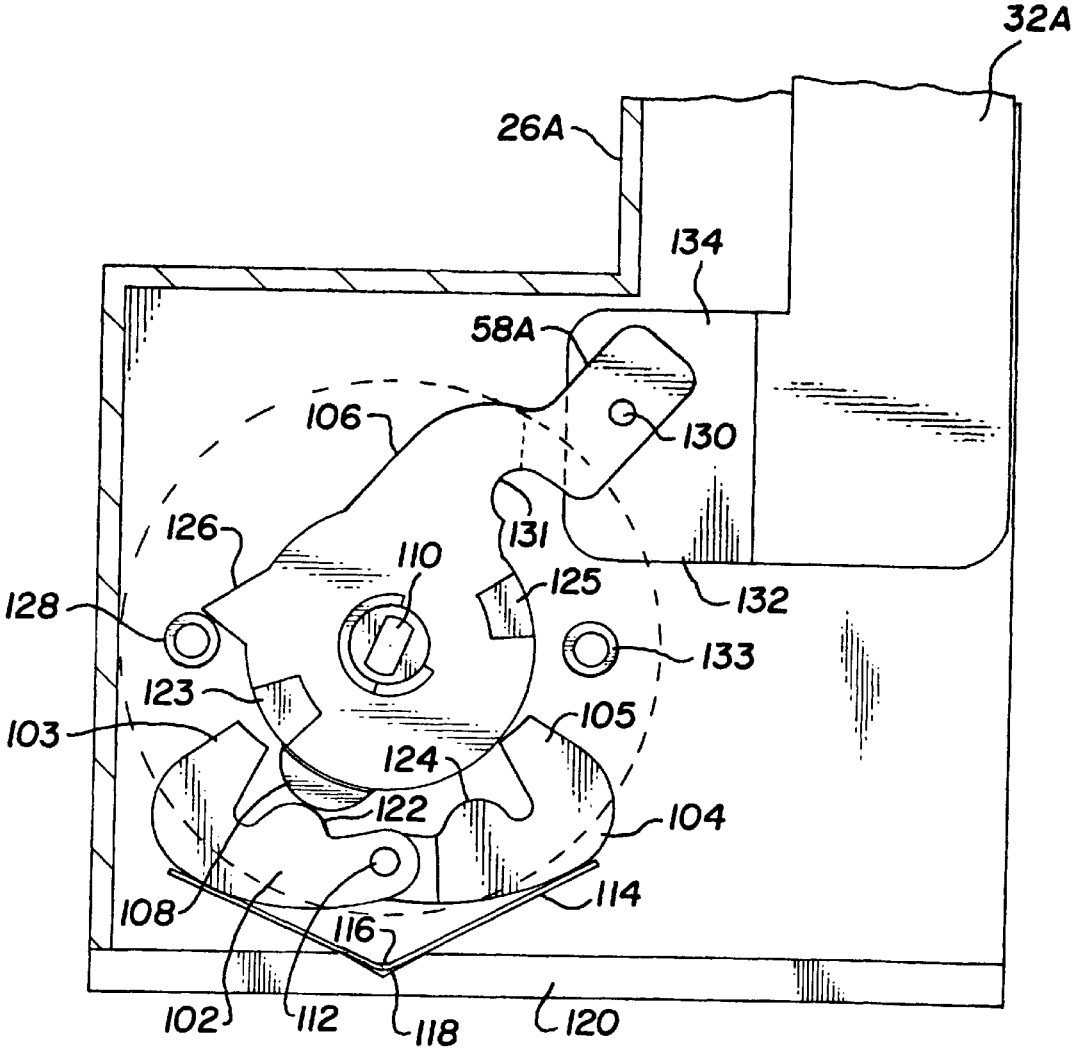
FIG. 8 is an enlarged view of the operating mechanism.

The various parts of the operating mechanism 100 are shown assembled and in operating condition in FIG. 8. The pawls 102 and 104 are joined by pin 112 for rotation about the pin and are urged inwardly by leaf spring 114 having a V-shape, the apex 116 of which fits into a V-shaped groove 118 formed in base 120.

The pawls 102 and 104 include cam followers 122 and 124 acted upon by cam 108 to disengage the pawls from slot 123 in the arm 106. As illustrated, the arm 106 has retracted the blade 32A fully within the U-shaped channel segment 26A. The counter-clockwise movement of the arm 106 is limited by a stop 126 engaging structure 128 of the door knob assembly. As shown, the arm 106 is free to move in a clockwise direction to move the blade outward by way of extension 58A on arm 106 connected by pin 130 to L-shaped portion 132 of blade 32A.

The clockwise movement of the arm 106 continues until the inner surface of slot 131 contacts the element 133. At this time, and end 105 of the pawl 104 enters slot 125 to lock the arm against movement. At this time the blade 32A is fully extended to lock the door against entry. Lock or latched condition of the operating mechanism 100 is illustrated in FIG. 7, both blades extended to lock the door. Operation of extending the blades by way of the arms is the same as that described above with regard to the embodiment of FIGS. 1–5. The upper surface of the arm 106 and the upper surface of the blade 32A are in the same plane by reason of the L-shaped extension the upper surface of the L-shaped extension 134 being relieved or otherwise reduced in thickness to approximately ½ its original thickness. The underside of the extension 58A is also reduced in thickness to approximately ½ its original thickness provide for the elements the arm 106 and the blade 132A being in the same plane.

Now, when it is desired to retract the blade 32A, and thus permit ingress by way of the door cam 108 is rotated to engage cam follower 124 to remove the end 105 of pawl 104 from the slot 125. The arm 106 is now free to be rotated in a counter-clockwise direction drawing the blades 30A and 32A into a recessed condition. The continued counter-clockwise rotation of the arm continues until the end 103 of pawl 102 enters the slot 123 and latches the arm against further movement.

Now that the invention has been described modifications will suggest themselves to those skilled in the art and it is applicant's intent not to be limited in any way by the specific nature of the foregoing description, but only by the claims which fallow.

What is claimed is:

1. A system for locking a door to a frame around said door, and for enabling said door to remain locked to said frame when an intrusive force is applied to said door, each of said door and said frame having a plurality of edges, the locking system comprising:

a first elongate locking blade having a length that is shorter than the length of a first edge of said door and adapted to be mounted lengthwise along said first edge of said door for movement between a corresponding channel formed along less than the entire length of said first edge of said door and a corresponding groove formed along less than the entire length of a first edge of said frame adjacent to said first edge of said door;

a first elongate reenforcing plate adapted to be positioned over said groove in said first edge of said frame and having a slot to allow for said movement of said first locking blade;

a second elongate locking blade having a length that is shorter than the length of a second edge of said door and adapted to be mounted lengthwise along said second edge of said door for movement between a corresponding channel formed along less than the entire length of said second edge of said door and a corresponding groove formed along less than the entire length of a second edge of said frame adjacent to said second edge of said door;

a second elongate reenforcing plate adapted to be positioned over said groove in said second edge of said frame and having a slot to allow for said movement of said second locking blade; and a mechanism for moving said first and second locking blades into a locking position wherein a portion of each of said first and second locking blades is positioned within said channels in said first and second edges of said door, respectively, and another portion of each of said first and second locking blades is positioned within said grooves in said first and second edges of said frame, respectively, thereby locking said door to said frame whereby said force is dispersed across said first and second locking blades thus allowing said door to remain locked to said frame despite the application of said force.

2. The system of claim 1 wherein substantially all of said first locking blade and substantially all of said second locking blade are positioned within said channels in said first and second edges of said door, respectively, when in a non-locking position.

3. The system of claim 1 wherein said moving mechanism is adapted to be located in said door.

4. The system of claim 1 wherein said first and second locking blades strike said first and second reenforcing plates, respectively, when said force is applied to said door.

5. The system of claim 1 wherein further comprising first and second channel members mounted in said channels in said first and second edges of said door, respectively, for receiving said first and second locking blades, respectively.

6. The system of claim 1 wherein said first edges of said door and said frame, respectively, are horizontal and said second edges of said door and said frame, respectively, are vertical.

7. A system for locking a door to a jamb, and for enabling said door to remain locked to said jamb when an intrusive force is applied to said door, the locking system comprising:

an elongate locking blade having a length that is substantially longer than one and one half inches but shorter than the length of an edge of said door and adapted to be mounted lengthwise along said edge of said door for movement between a corresponding channel formed along less than the entire length of said edge of said door and a corresponding groove formed along less than the entire length of an edge of said jamb adjacent to said door edge;

an elongate reenforcing plate adapted to be positioned over said groove in said jamb edge and having a slot to allow for said movement of said locking blade; and a mechanism for moving said locking blade into a locking position wherein a portion of said locking blade is positioned within said channel in said door edge and another portion of said locking blade is positioned within said groove in said jamb edge thereby locking said door to said jamb whereby said force is dispersed across said locking blade thus allowing said door to remain locked to said jamb despite the application of said force.

8. The system of claim 7 wherein substantially all of said locking blade is positioned within said channel in said door edge when in a non-locking position.

9. The system of claim 7 wherein said moving mechanism is adapted to be located in said door.

10. The system of claim 7 wherein said locking blade strikes said reenforcing plate when said force is applied to said door.

11. The system of claim 7 further comprising an elongate channel member adapted to be mounted in said channel in said door for receiving said locking blade.

12. The system of claim 7 wherein said door edge and said jamb edge are horizontal.

13. The system of claim 7 wherein said door edge and said jamb edge are vertical.

14. A system for locking a movable structure to an adjacent fixed structure, and for enabling said movable structure to remain to said fixed structure when an intrusive force is applied to said movable structure, the locking system comprising:

an elongate locking blade having a length that is substantially longer than one and one half inches but shorter than the length of adjacent edges of said movable structure and said fixed structure, respectively, and adapted to be mounted lengthwise along said edges for movement between a first receiving channel formed along less than the entire length of one of said edges and a second receiving channel formed along less than the entire length of the other of said edges;

an elongate reenforcing plate adapted to be positioned over said first receiving channel and having a slot to allow for said movement of said locking blade; and an operating mechanism for partially moving said locking blade from one of said first and second receiving channels into the other of said first and second receiving channels to lock said movable structure to said adjacent fixed structure whereby said force is dispersed across said locking blade thus allowing said movable structure to remain locked to said fixed structure despite the application of said force.

15. The system of claim 14 wherein substantially all of said locking blade is retracted into said second receiving channel to unlock said movable structure from said adjacent fixed structure.

16. The system of claim 14 wherein said operating mechanism is adapted to be located in said movable structure.

17. The system of claim 14 wherein said movable structure is a door and said adjacent fixed structure is a jamb.

18. The system of claim 14 wherein said first and second receiving channels are formed along horizontal edges of said movable structure and said adjacent fixed structure, respectively.

19. The system of claim 14 wherein said first and second receiving channels are formed along vertical edges of said movable structure and said adjacent fixed structure, respectively.

20. A system for locking a door to an adjacent jamb, and for enabling said door to remain locked to said jamb when an intrusive force is applied to said door, the system comprising:

at least one elongate locking blade having a length that is substantially longer than one and one half inches but shorter than the length of at least one edge of said door and adapted to be mounted lengthwise along said at least one edge of said door for movement between at least one channel formed along less than the entire length of said at least one edge of said door and at least one groove formed along less than the entire length of at least one edge of said jamb;

at least one elongate channel member adapted to be secured within said at least one door edge for receiving said at least one locking blade; and an operating mechanism for moving said at least one locking blade partially from said at least one channel member into engagement with said at least one groove in said jamb thereby locking said door to said jamb whereby said force is dispersed across said at least one locking blade thus allowing said door to remain locked to said jamb despite the application of said force.

21. The system of claim 20 further comprising at least one elongate reenforcing plate adapted to be positioned over said at least one groove in said jamb and having a slot to allow for said movement of said at least one locking blade.

22. The system of claim 21 wherein said at least one locking blade strikes said at least one reenforcing plate when said force is applied to said door.

23. The system of claim 20 wherein said at least one door edge comprises a horizontal edge of said door.

24. The system of claim 20 wherein said at least one door edge comprises a vertical edge of said door.

25. The system of claim 20 wherein said operating mechanism is adapted to be mounted in said door.

* * * * *